US010865621B2

(12) United States Patent
Le

(10) Patent No.: US 10,865,621 B2
(45) Date of Patent: Dec. 15, 2020

(54) PRESSURE EQUALIZATION FOR WELL PRESSURE CONTROL DEVICE

(71) Applicant: WEATHERFORD TECHNOLOGY HOLDINGS, LLC, Houston, TX (US)

(72) Inventor: Tuong T. Le, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 230 days.

(21) Appl. No.: 15/783,871

(22) Filed: Oct. 13, 2017

(65) Prior Publication Data

US 2019/0112897 A1 Apr. 18, 2019

(51) Int. Cl.

| | |
|---|---|
| ***E21B 33/06*** | (2006.01) |
| ***E21B 33/12*** | (2006.01) |
| ***E21B 34/10*** | (2006.01) |
| ***E21B 33/08*** | (2006.01) |
| *E21B 33/064* | (2006.01) |

(52) U.S. Cl.

CPC ..... *E21B 34/105* (2013.01); *E21B 33/06* (2013.01); *E21B 33/085* (2013.01); *E21B 33/12* (2013.01); *E21B 33/064* (2013.01); *E21B 2200/06* (2020.05)

(58) Field of Classification Search

CPC ..... E21B 33/06; E21B 33/064; E21B 33/085; E21B 33/12; E21B 34/105

See application file for complete search history.

(56) References Cited

U.S. PATENT DOCUMENTS

| | | | |
|---|---|---|---|
| 2,921,633 | A | 1/1960 | Baker |
| 3,207,221 | A | 9/1965 | Cochran et al. |
| 3,991,826 | A | 11/1976 | Baugh |
| 4,842,082 | A | 6/1989 | Springer |
| 6,095,249 | A | 8/2000 | McGarian et al. |
| 6,263,969 | B1 | 7/2001 | Stoesz et al. |
| 6,899,179 | B2 | 5/2005 | McGarian et al. |
| 7,159,669 | B2 | 1/2007 | Bourgoyne et al. |

(Continued)

OTHER PUBLICATIONS

Office Action dated Jul. 10, 2018 for U.S. Appl. No. 15/153,356, 9 pages.

(Continued)

*Primary Examiner* — Matthew R Buck
(74) *Attorney, Agent, or Firm* — Smith IP Services, P.C.

(57) ABSTRACT

A method can include positioning a tubular string in a riser string including an outer housing of a pressure control device and an annular seal operable to prevent flow through an annulus between the tubular and riser strings, the tubular string including an equalization valve and a running tool operable to convey a releasable assembly of the pressure control device through the riser string, and opening the equalization valve, thereby permitting fluid communication between the annulus and a flow passage extending longitudinally through the tubular string. A system can include a riser string including an annular blowout preventer with an annular seal, a tubular string including a running tool and an equalization valve releasably attachable to a releasable assembly including an annular seal, and the equalization valve selectively preventing and permitting fluid communication between a flow passage of the tubular string and an annulus between the annular seals.

18 Claims, 11 Drawing Sheets

(56) References Cited

U.S. PATENT DOCUMENTS

| | | | | |
|---|---|---|---|---|
| 7,487,837 | B2 | 2/2009 | Bailey et al. | |
| 7,699,109 | B2 * | 4/2010 | May | E21B 33/085 166/367 |
| 7,836,946 | B2 | 11/2010 | Bailey et al. | |
| 7,926,593 | B2 | 4/2011 | Bailey et al. | |
| 7,997,345 | B2 | 8/2011 | Hannegan | |
| 9,051,790 | B2 * | 6/2015 | Orbell | E21B 17/085 |
| 9,353,587 | B2 * | 5/2016 | Bansal | E21B 34/12 |
| 9,611,708 | B2 | 4/2017 | Rios, III | |
| 10,006,270 | B2 * | 6/2018 | Schwendemann | E21B 17/01 |
| 10,287,838 | B2 | 5/2019 | Van Bilderbeek et al. | |
| 2003/0106712 | A1 | 6/2003 | Bourgoyne et al. | |
| 2005/0023866 | A1 | 2/2005 | Matusek et al. | |
| 2005/0236158 | A1 | 10/2005 | Miyahara | |
| 2009/0161997 | A1 | 6/2009 | Beauchamp et al. | |
| 2010/0175882 | A1 | 7/2010 | Bailey et al. | |
| 2010/0243235 | A1 | 9/2010 | Caldwell et al. | |
| 2011/0036638 | A1 | 2/2011 | Sokol et al. | |
| 2012/0013133 | A1 | 1/2012 | Rios et al. | |
| 2012/0085545 | A1 | 4/2012 | Tarique et al. | |
| 2012/0292054 | A1 | 11/2012 | Orbell et al. | |
| 2012/0318496 | A1 | 12/2012 | Bailey et al. | |
| 2013/0133891 | A1 * | 5/2013 | Getzlaf | E21B 34/12 166/308.1 |
| 2013/0153242 | A1 * | 6/2013 | Flight | E21B 33/0355 166/363 |
| 2014/0014353 | A1 | 1/2014 | Rios, III | |
| 2014/0069720 | A1 | 3/2014 | Gray | |
| 2016/0123399 | A1 * | 5/2016 | Arnt | F16C 35/042 384/559 |
| 2016/0245028 | A1 * | 8/2016 | Arnt | E21B 3/02 |
| 2016/0245037 | A1 | 8/2016 | Gray et al. | |
| 2016/0305213 | A1 | 10/2016 | Godfrey et al. | |
| 2017/0114602 | A1 | 4/2017 | Grace | |

OTHER PUBLICATIONS

Office Action dated Feb. 5, 2019 for U.S. Appl. No. 15/153,356, 6 pages.

European Search Report dated Dec. 2, 2018 for EP Patent Application No. 17170899.3, 11 pages.

Office Action dated Apr. 6, 2018 for U.S. Appl. No. 15/153,356, 16 pages.

Office Action dated Jun. 6, 2017 for U.S. Appl. No. 15/153,356, 12 pages.

Office Action datedMar. 7, 2019 for U.S. Appl. No. 15/850,186, 32 pages.

Advisory Action dated Apr. 4, 2019 for U.S. Appl. No. 15/153,356, 19 pages.

Office Action dated Nov. 28, 2018 for U.S. Appl. No. 15/153,356, 10 pages.

International Search Report with Written Opinion dated Jan. 10, 2019 for PCT Patent Application No. PCT/US2018/053470, 11 pages.

Specification and drawings for U.S. Appl. No. 15/153,356, filed May 12, 2016, 72 pages.

Office Action dated Jun. 28, 2019 for U.S. Appl. No. 15/850,186, 16 pages.

Office Action dated Jan. 17, 2020 for U.S. Appl. No. 15/850,186, 12 pages.

* cited by examiner

PRESSURE EQUALIZATION FOR WELL PRESSURE CONTROL DEVICE

BACKGROUND

This disclosure relates generally to equipment utilized and operations performed in conjunction with a subterranean well and, in examples described below, more particularly provides for pressure equalization, for example, when installing and retrieving a releasable assembly of a pressure control device.

A pressure control device is typically used to seal off an annular space between an outer tubular structure (such as, a riser, a housing on a subsea structure in a riser-less system, or a housing attached to a surface wellhead) and an inner tubular (such as, a drill string, a test string, etc.). At times it may be desired for components (such as, bearings, seals, etc.) of the pressure control device to be retrieved from, or installed in, an outer housing (such as, a riser housing).

Therefore, it will be appreciated that advancements are continually needed in the arts of installing and retrieving releasable assemblies of pressure control devices. In particular, it would be desirable to provide for convenient and efficient installation and retrieval of pressure control device components respectively into and out of an outer housing.

DETAILED DESCRIPTION

Figure 1:
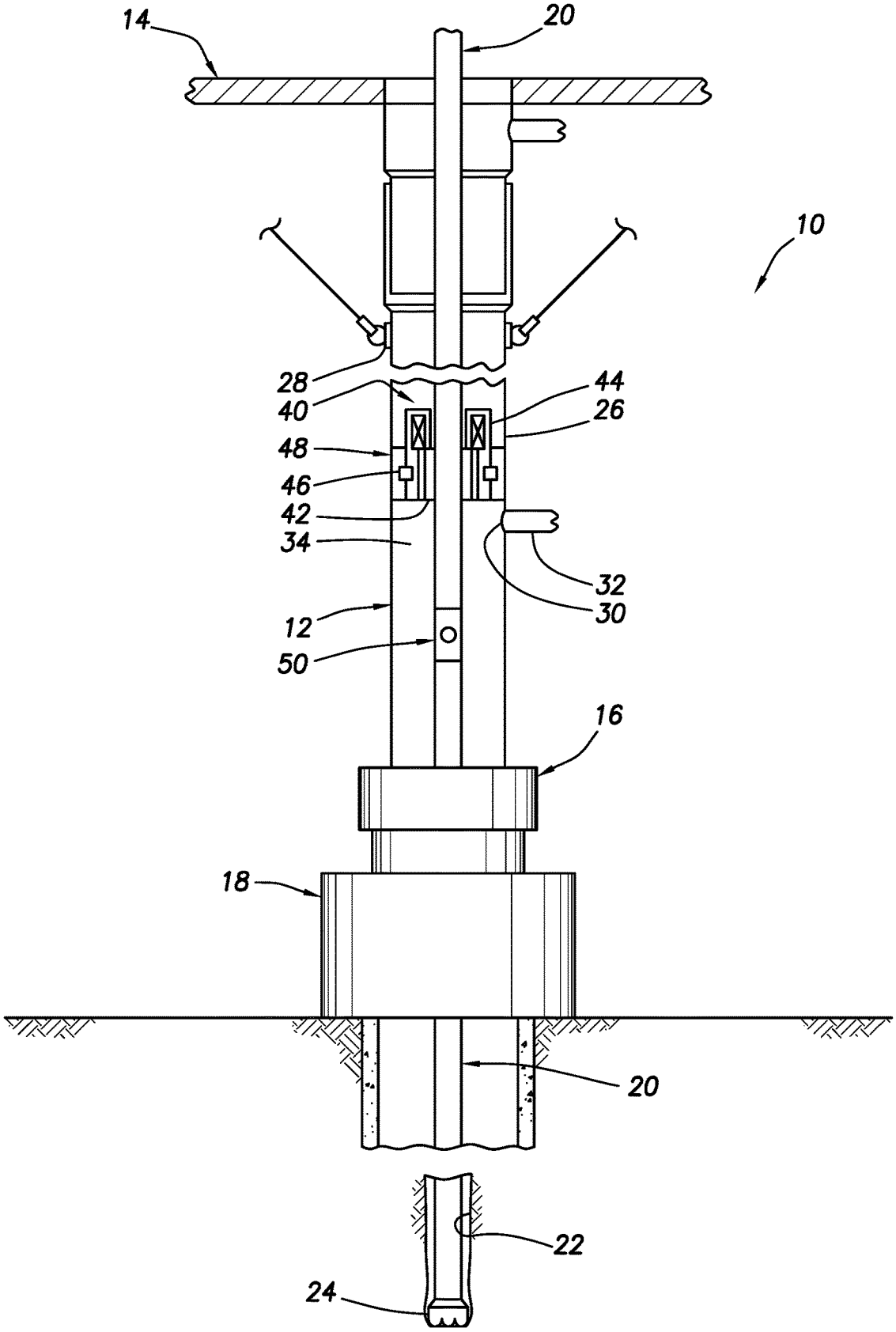
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower or distal end of the tubular string 20.

The drill bit 24 may be rotated by rotating the tubular string 20 (for example, using a top drive or rotary table of the rig 14), and/or a drilling motor (not shown) may be connected in the tubular string 20 above the drill bit 24. However, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes an outer riser housing 26 connected in the riser string 12 below a tensioner ring 28 suspended from the rig 14. In other examples, the riser housing 26 could be connected above the tensioner ring 28, or could be otherwise positioned (such as, in the wellhead installation 18 in a riser-less configuration). Thus, the scope of this disclosure is not limited to any particular details of the riser string 12 or riser housing 26 as described herein or depicted in the drawings.

The riser housing 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a releasable assembly 40 is installed in the riser housing 26. The releasable assembly 40 in this example is of the type known to those skilled in the art as a rotating control device. The releasable assembly 40 and the outer riser housing 26 comprise a pressure control device 48.

However, the scope of this disclosure is not limited to installation or retrieval of any particular type of releasable assembly in the riser housing 26. In other examples, the releasable assembly 40 could comprise a portion of a non-rotating pressure control device (e.g., having one or more non-rotating annular seals for engagement with the tubular string 20).

In the FIG. 1 example, the releasable assembly 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the riser housing 26 is provided for by a bearing assembly 44 of the releasable assembly 40. The annular seals 42 and bearing assembly 44 are releasably secured in the riser housing 26 by a latch 46. The latch 46 permits the annular seals 42 and/or the bearing assembly 44 to be installed in, or retrieved from, the riser housing 26 when desired, for example, to service or replace the seals 42 and/or bearing assembly 44.

Various components of the latch 46 may be part of, or integral to, the riser housing 26, the releasable assembly 40, or a combination thereof. The scope of this disclosure is not limited to any particular location(s) or configuration of any components or combination of components of the latch 46.

The tubular string 20 can include a running tool, an example of which is described more fully below and depicted in FIGS. 9 & 10, for installing and retrieving the releasable assembly 40. However, it should be clearly understood that the scope of this disclosure is not limited to this particular example of the running tool.

The tubular string 20 in the FIG. 1 example includes an equalization valve 50 for selectively providing fluid communication between the annulus 34 and an interior of the tubular string. More specifically, the equalization valve 50 can be operated to permit fluid communication with a section of the annulus 34 located between the annular seal 42 of the releasable assembly 40 and an annular seal (not visible in FIG. 1) of the lower marine riser package 16 (for example, an annular seal of an annular blowout preventer, see FIGS. 10 & 11).

The fluid communication between this section of the annulus 34 and the interior of the tubular string 20 may be used to prevent the annulus section from being isolated while installing or retrieving the releasable assembly 40, and while the annular seals of the releasable assembly and the lower marine riser package 16 are sealingly engaged with the exterior of the tubular string. The fluid communication may in some cases be used to perform pressure tests on the annular seals of the releasable assembly 40 and the lower marine riser package 16. Thus, the scope of this disclosure is not limited to any particular purpose, function or use for the equalization valve 50.

Figure 2:
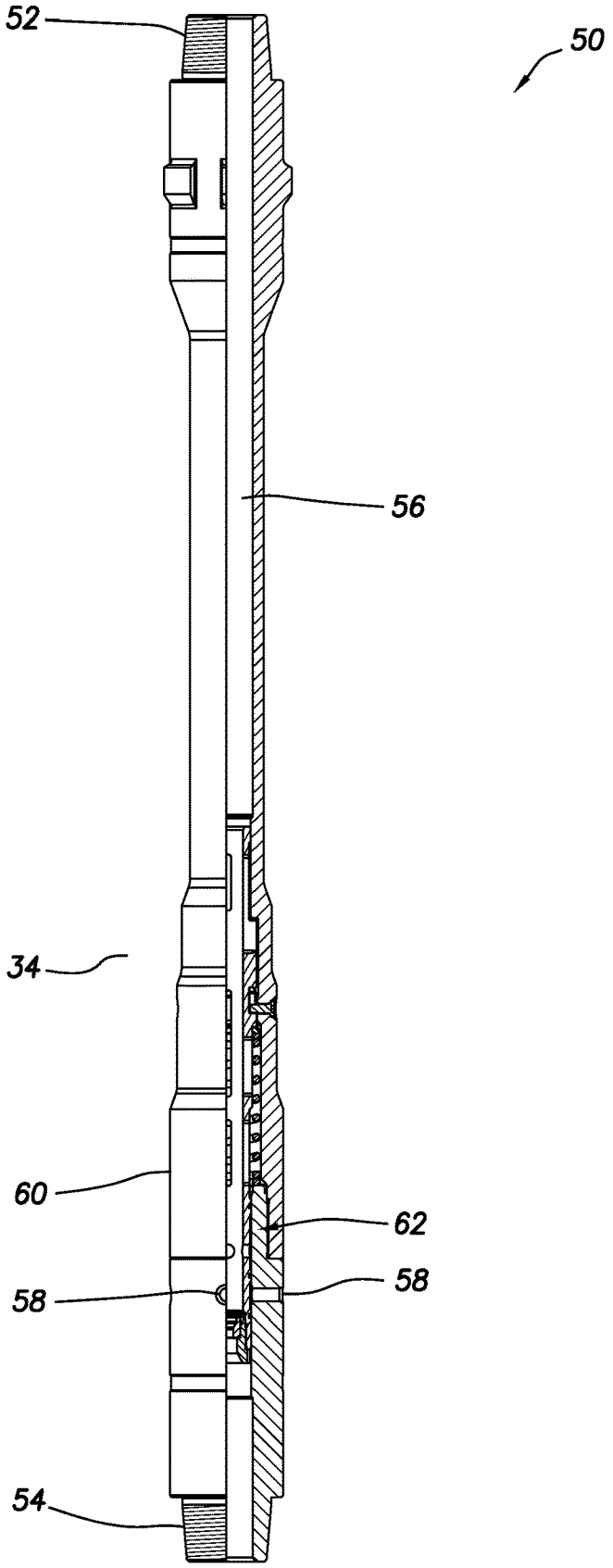
FIG. 2 is a representative partially cross-sectional view of an example of an equalization valve that may be used in the well system and method of FIG. 1, and which can embody the principles of this disclosure.

Referring additionally now to FIG. 2, an example of the equalization valve 50 is representatively illustrated, apart from the remainder of the well system 10. For convenience and clarity, the equalization valve 50 is described below as it may be used in the FIG. 1 system 10 and method, but it should be clearly understood that the equalization valve may be used with other systems and methods, in keeping with the principles of this disclosure.

As depicted in FIG. 2, the equalization valve 50 includes upper and lower connectors 52, 54 for connecting the equalization valve in the tubular string 20. The connectors 52, 54 are illustrated as being externally threaded for sealing threaded engagement with other components of the tubular string 20, but other types of connectors may be used in other examples.

When connected in the tubular string 20, an internal flow passage 56 of the tubular string extends longitudinally through the equalization valve 50. When in its open configuration (see FIG. 7), fluid communication is permitted between the flow passage 56 and the annulus 34 external to the equalization valve 50.

Ports 58 are formed radially through a housing assembly 60 of the equalization valve 50. A closure assembly 62 selectively prevents and permits flow through the ports 58, and thereby selectively prevents and permits fluid communication between the annulus 34 and the flow passage 56 via the ports.

Figure 3:
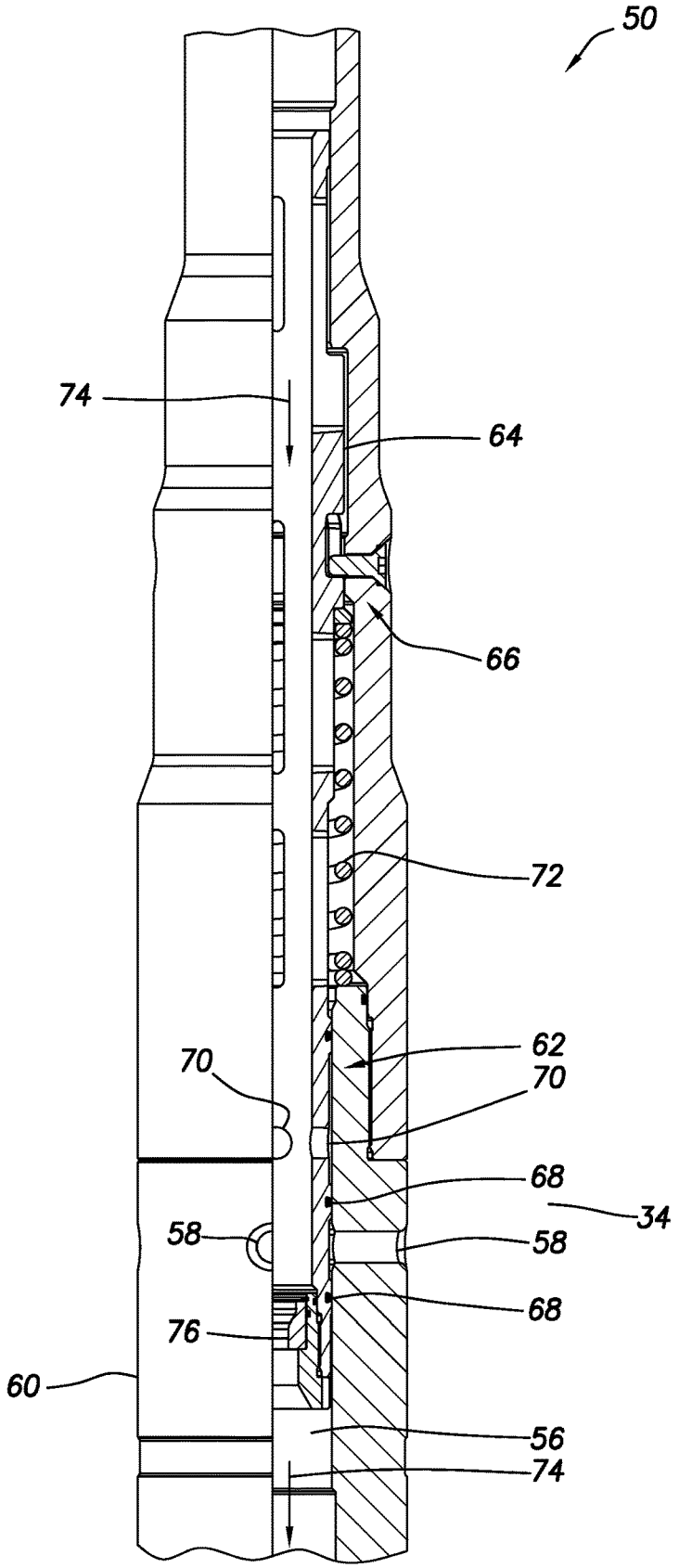
FIG. 3 is a representative partially cross-sectional view of a portion of the equalization valve.

Referring additionally now to FIG. 3, a portion of the equalization valve 50 is representatively illustrated at an increased scale. In this view it may be more clearly seen that a generally tubular mandrel 64 is reciprocably disposed in the housing assembly 60 of the equalization valve 50. The mandrel 64 serves as a component of the closure assembly 62 and a component of an indexing device 66 of the equalization valve 50.

In a closed position of the mandrel 64 depicted in FIG. 3, the mandrel blocks flow through the ports 58. Seals 68 carried on the mandrel 64 longitudinally straddle the ports 58. However, if the mandrel 64 is displaced downward (as viewed in FIG. 3) relative to the housing assembly 60, ports 70 formed radially through the mandrel will eventually become aligned with the ports 58, and fluid communication through the aligned ports 58, 70 will be permitted.

The mandrel 64 is biased upward toward its FIG. 3 closed position by a biasing device 72 (such as, a coiled compression spring, a compressed gas chamber, a resilient solid or liquid substance, etc.). The mandrel 64 will displace downward if an upward biasing force exerted by the biasing device 72 is exceeded by a downwardly directed force applied to the mandrel.

The downwardly directed force can be applied to the mandrel 64 by flowing a fluid 74 downward through the flow passage 56. In the FIG. 3 example, the fluid 74 flows through a flow restriction 76 in the mandrel 64, so that a pressure differential is created across the flow restriction.

The flow restriction 76 is depicted in FIG. 3 as comprising an orifice having a reduced diameter as compared to that of the flow passage 56. In other examples, the flow restriction 76 could comprise another type of flow impediment, obstruction, venturi or other means of producing a pressure differential.

In the FIG. 3 example, the pressure differential is created from above to below the flow restriction 76, and so the downwardly directed force is produced as a result of the fluid 74 flow through the passage 56. When the fluid 74 is flowed at or above a predetermined flow rate, the downwardly directed force produced due to the pressure differential will exceed the upward biasing force exerted by the biasing device 72, and the mandrel 64 will displace downward.

The indexing device 66 limits displacement of the mandrel 64 in response to the forces applied to the mandrel 64. In addition, the indexing device 66 controls whether the mandrel 64 is in its closed or open position when the fluid 74 is not flowing through the passage 56 (or is not flowing at a sufficient flow rate to overcome the upward biasing force exerted by the biasing device 72).

Note that it is not necessary for the closure assembly 62 to be positioned downstream of (or below) the indexing device 66 as depicted in FIG. 3. The closure assembly 62 could instead be positioned upstream of (or above) the indexing device 66, or the closure assembly and the indexing device could be located at approximately a same longitudinal position in the equalization valve 50. Thus, the scope of this disclosure is not limited to any particular arrangement, configuration or components used for the closure assembly 62 or the indexing device 62.

Figure 4:
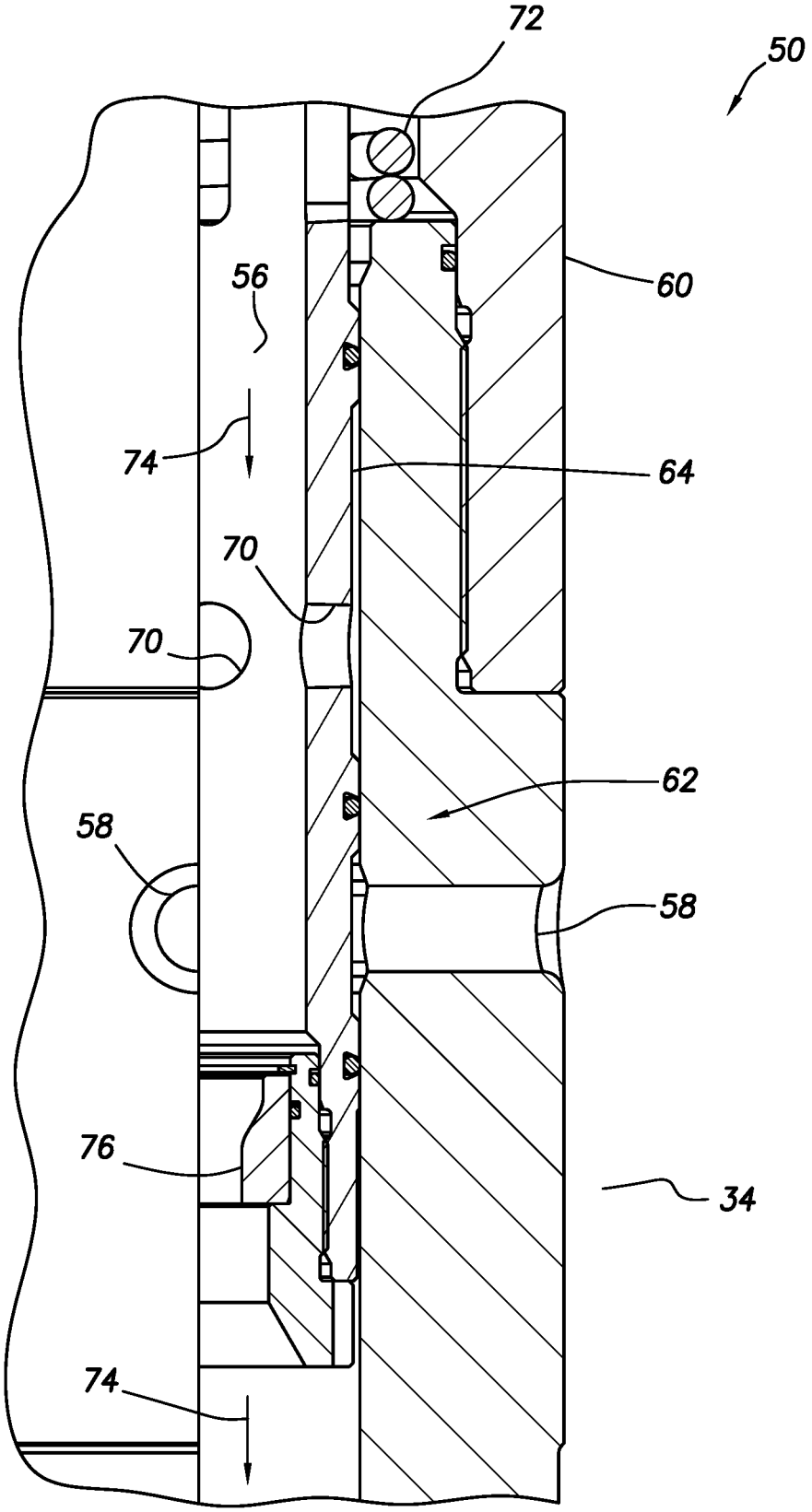
FIG. 4 is a representative partially cross-sectional view of a closure section of the equalization valve.

Referring additionally now to FIG. 4, a closure section of the equalization valve 50 is representatively illustrated at a further increased scale. In this view it may be more clearly seen that the flow restriction 76 is replaceable in the mandrel 64.

A more or less restrictive flow restriction 76 may conveniently be installed in the mandrel 64, in order to accommodate different well conditions (such as, varying fluid 74 viscosity or different desired pressure differentials across the flow restrictor). The flow restriction 76 can be made of an erosion resistant material, and can be conveniently replaced if it does become eroded.

Note that the flow restriction 76 is positioned downstream of the ports 70 (with respect to the fluid flow 74) in the FIG. 4 example. In other examples, the flow restriction 76 could be positioned upstream of the ports 70, or the flow restriction could be otherwise positioned relative to the mandrel 64.

By positioning the flow restriction 76 downstream of the ports 70, the pressure differential created from upstream to downstream of the flow restriction due to the fluid flow 74 can be applied from the annulus 34 exterior to the equalization valve 50 to the flow passage 56 downstream of the flow restriction, for example, to perform pressure testing as described more fully below. This is due to the fact that, in the open position of the mandrel 64, the flow passage 56 upstream of the flow restriction 76 is in fluid communication with a section of the annulus 34 external to the equalization valve 50.

Figure 5:
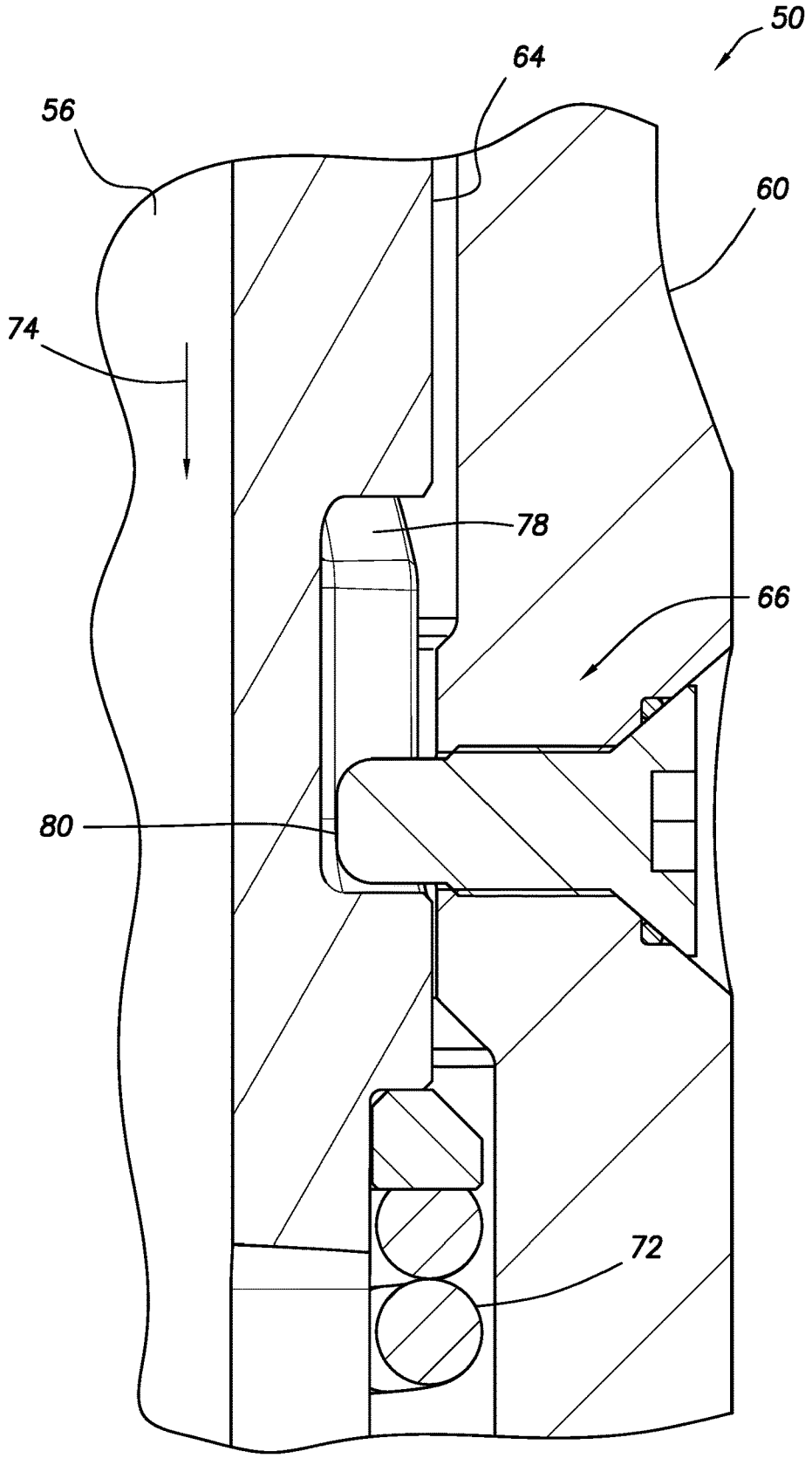
FIG. 5 is a representative cross-sectional view of an indexing section of the equalization valve.

Referring additionally now to FIG. 5, an enlarged scale view of the indexing device 66 is representatively illustrated. In this view, it may be more clearly seen that the indexing device 66 includes an indexing profile 78 formed on the mandrel 64, and a follower or pin 80 engaged with the indexing profile and secured to the housing assembly 60. Two of the pins 80 are provided in this example, but any number of the pins (including one) may be provided in other examples.

The indexing profile 78 in this example is of the type known to those skilled in the art as a "J-slot," since portions of the profile resemble the letter "J." The profile 78 extends circumferentially and continuously about the mandrel 64, and is configured to limit longitudinal displacements of the mandrel relative to the housing assembly 60, thereby controlling the relative positions of the ports 58, 70 (not visible in FIG. 5, see FIG. 4).

Figure 6:
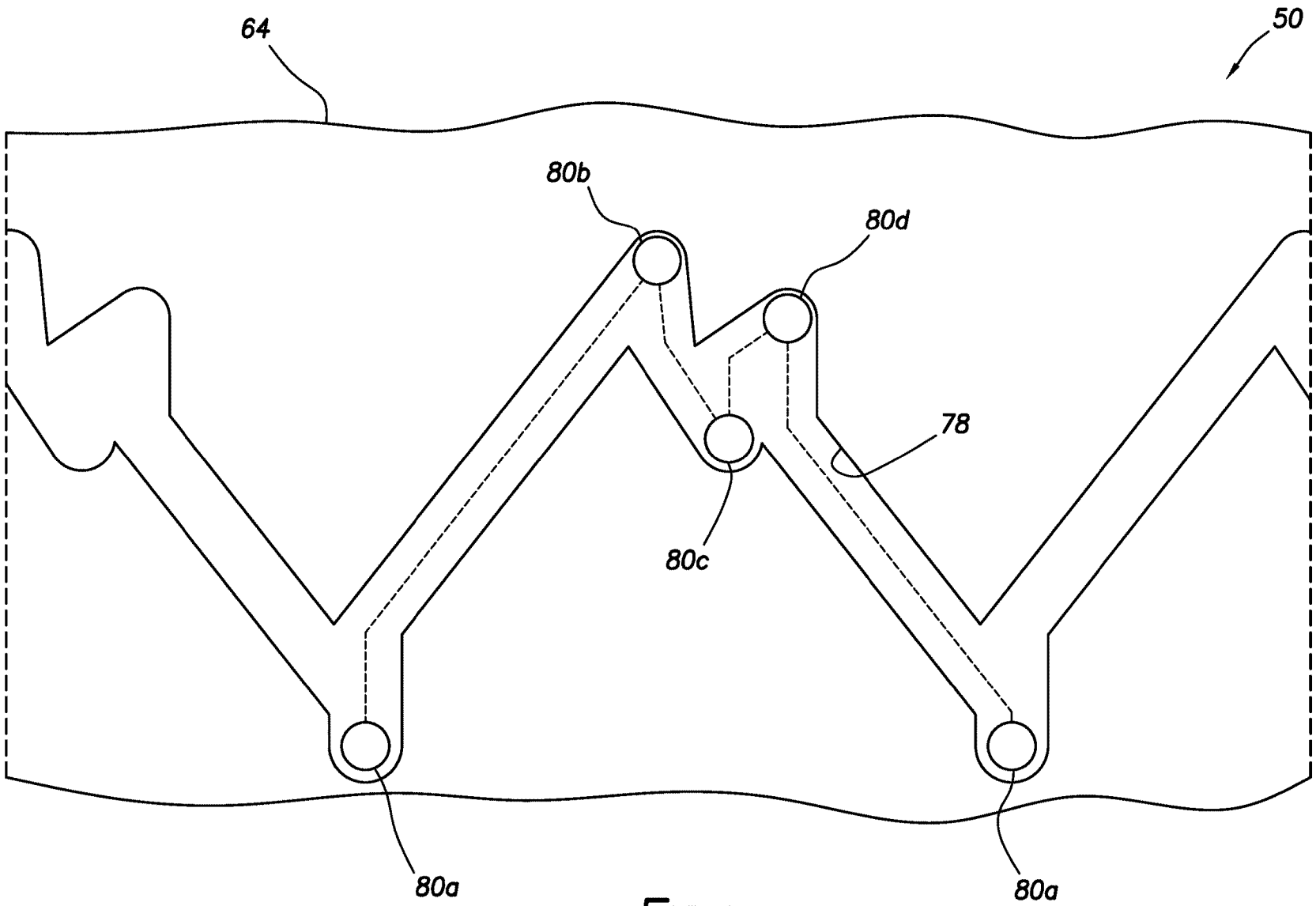
FIG. 6 is a representative flattened elevational view of an indexing profile of the indexing section.

Referring additionally now to FIG. 6, an "unrolled" or "flattened" view of the indexing profile 78 is representatively illustrated. In this example, the profile 78 is configured so that the mandrel 64 will be positioned alternately at its closed and open positions in response to corresponding sets of fluid 74 flow rate increases and decreases. However, in other examples the profile 78 could be configured to require multiple sets of flow rate increases and decreases to change from its closed to its open position, or from its open to its closed position.

In the closed position of the mandrel 64, the pin 80 is at the position 80*a* depicted in FIG. 6. When the fluid 74 flow rate is increased to a level at or greater than the predetermined flow rate as discussed above, the mandrel 64 will displace downward, until the pin 80 is at the position 80*b*.

When the flow rate is subsequently decreased, the mandrel 64 will displace upward (due to the biasing force exerted by the biasing device 72), until the pin 80 is at the position 80*c*. Note that the position 80*c* is longitudinally offset from the position 80*a*.

The position 80*c* corresponds to the open position of the mandrel 64. Thus, the mandrel 64 is caused to shift from its closed position to its open position in response to a flow rate increase (to a level of at least the predetermined flow rate) followed by a flow rate decrease.

When the fluid 74 flow rate is then increased to a level of at least the predetermined flow rate, the mandrel 64 will displace downward, until the pin 80 is at the position 80*d*. A subsequent flow rate decrease will cause the mandrel 64 to displace upward (due to the biasing force exerted by the biasing device 72), until the pin 80 is at the position 80*a*.

Thus, the mandrel 64 returns to its closed position. The mandrel 64 can again be shifted to its open position by another set of a flow increase followed by a flow decrease. The mandrel 64 can be shifted between its open and closed positions downhole any number of times by applying a corresponding number of flow increases and decreases.

Figure 7:
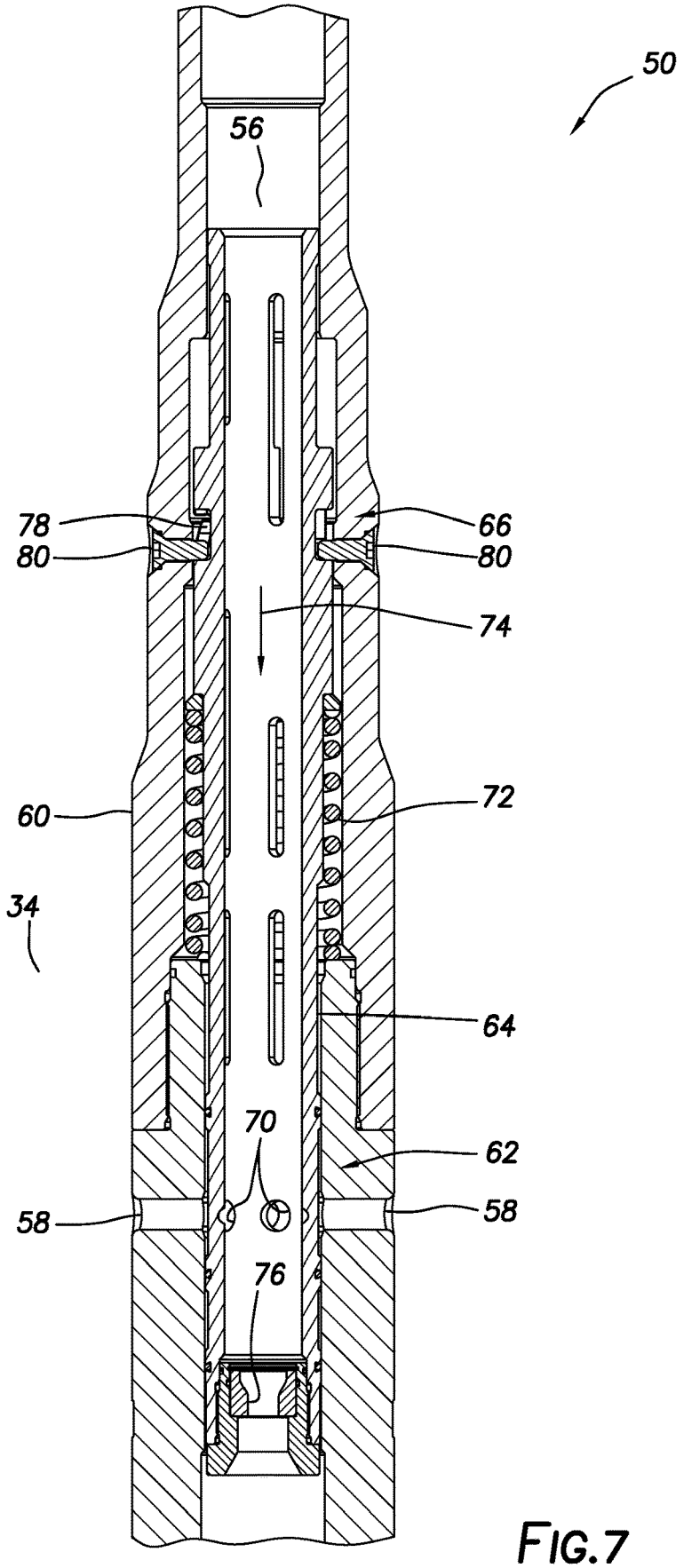
FIG. 7 is a representative cross-sectional view of the equalization valve in an open configuration.

Referring additionally now to FIG. 7, a cross-sectional view of the equalization valve 50 is representatively illustrated. The equalization valve 50 is depicted in its open configuration in FIG. 7. The pins 80 are in the positions 80*c* (see FIG. 6) in the open configuration, as described above.

In the open configuration, the ports 58, 70 are aligned, so that fluid communication is permitted between the annulus 34 and the flow passage 56. Note that it is not necessary for the ports 58, 70 to be longitudinally, radially or otherwise aligned, since the ports could be placed in fluid communication with each other, even if they are longitudinally, radially or otherwise offset in other examples. Thus, the scope of this disclosure is not limited to any particular configuration, arrangement or alignment of the ports 58, 70.

It will be appreciated by those skilled in the art that, if there is fluid 74 flow downward through the passage 56 in the open configuration depicted in FIG. 7, fluid pressure in the passage 56 upstream of the flow restriction 76 will be greater than fluid pressure in the passage 56 downstream of the flow restriction. This elevated fluid pressure upstream of the flow restriction 76 will be communicated to the annulus 34 external to the equalization valve 50 via the ports 58, 70.

Figure 8:
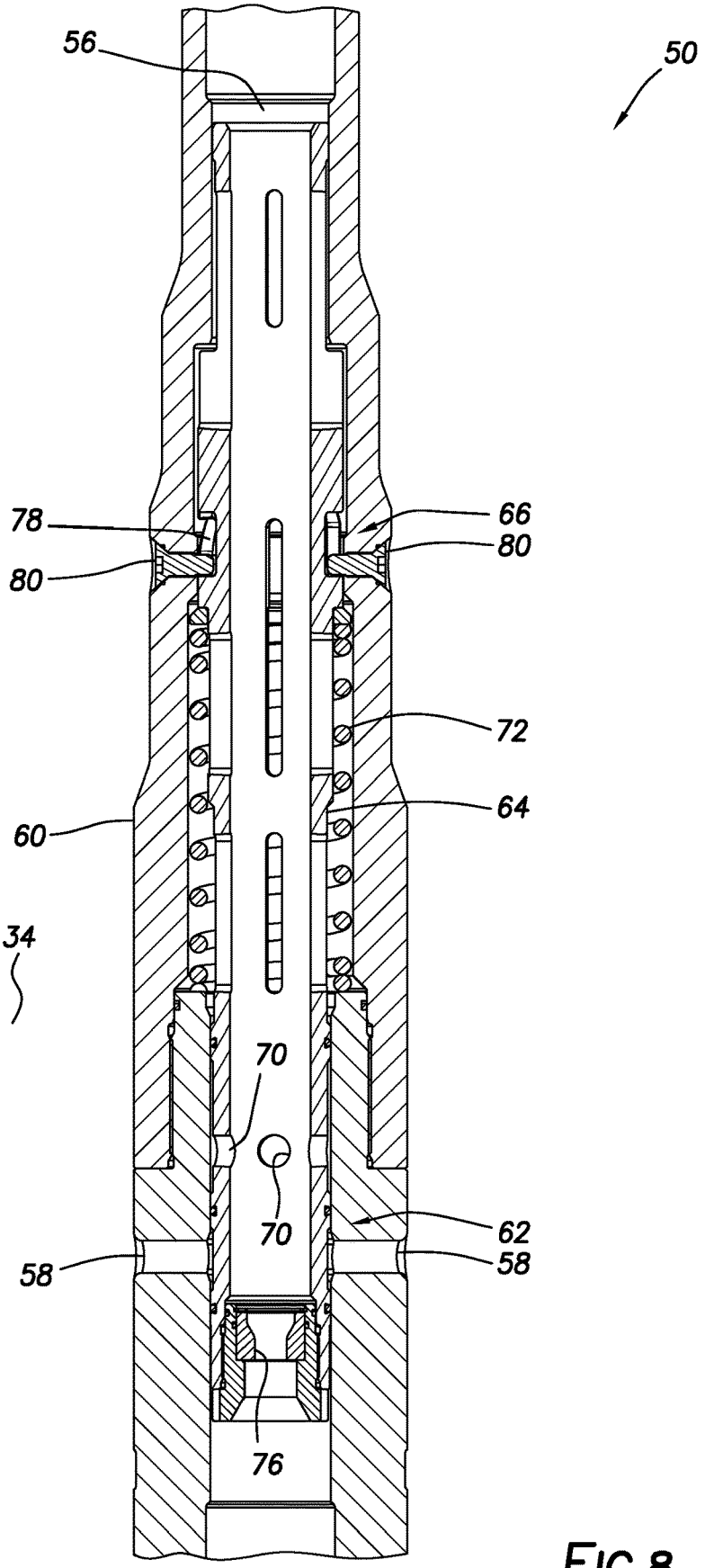
FIG. 8 is a representative cross-sectional view of the equalization valve in a closed configuration.

Referring additionally now to FIG. 8, the equalization valve 50 is representatively illustrated as having been returned to its closed configuration. In this closed configuration, fluid communication between the flow passage 56 and the annulus 34 external to the equalization valve 50 is prevented. The pins 80 are in the positions 80*a* (see FIG. 6) in the closed configuration, as described above. The FIG. 8 closed configuration is essentially the same as that depicted in FIGS. 2-5.

Figure 9:
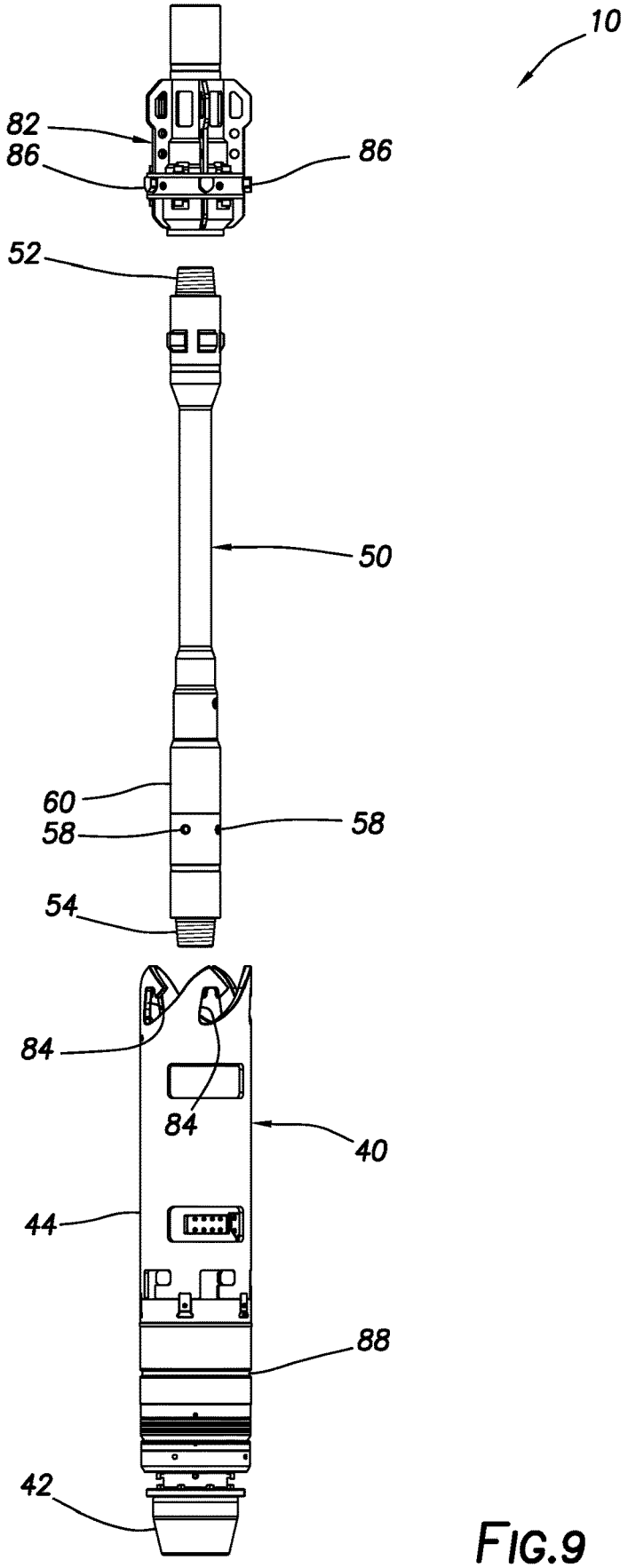
FIG. 9 is a representative exploded elevational view of the equalization valve, an example of a releasable assembly and an example of a running tool for the releasable assembly.

Referring additionally now to FIG. 9, an exploded view of the equalization valve 50 with additional components of the system 10 is representatively illustrated. In this view, a more detailed example of the releasable assembly 40 is depicted, and an example of a running tool 82 that may be used to convey the releasable assembly is depicted.

The releasable assembly 40 example depicted in FIG. 9 includes two of the annular seals 42, although only one of the annular seals is visible in FIG. 9. The annular seals 42 are passive seals of the type known to those skilled in the art as "stripper rubbers" that can sealingly engage a tubular string or other suitably configured components positioned in the stripper rubbers. However, the scope of this disclosure is not limited to use of any particular type, configuration or number of annular seals with the releasable assembly 40.

The annular seals 42 can rotate with a tubular string or other component sealingly engaged by the annular seals. The bearing assembly 44 is used to provide for such rotation relative to the outer housing 26 connected in the riser string 12 (see FIG. 1) as described above. However, the scope of this disclosure is not limited to use of rotatable annular seals or a bearing assembly with the releasable assembly 40.

As depicted in FIG. 9, a series of helical or "J"-shaped slots 84 are formed at an upper end of the releasable assembly 40. These slots 84 provide for releasable attachment of the running tool 82 to the releasable assembly 40. The running tool 82 includes a corresponding series of outwardly extending dogs or lugs 86 configured to releasably engage the slots 84.

In this manner, the running tool 82 can be used to install the releasable assembly 40 into the outer housing 26, and to retrieve the releasable assembly from the outer housing. When appropriately positioned in the outer housing 26, the latch 46 (see FIG. 1) can engage an annular recess 88 on the releasable assembly 40 to thereby releasably secure the releasable assembly relative to the outer housing.

When the running tool 82 is used to convey the releasable assembly 40 through the riser string 12 in the FIG. 1 system 10, the equalization valve 50 is connected below the running tool (for example, using the upper connector 52). Additional components of the tubular string 20 (not shown in FIG. 9, see FIG. 1) are connected above the running tool 82 and below the equalization valve 50. The releasable assembly 40 is releasably secured to the running tool 82 via the slots 84 and lugs 86, with an upper portion of the equalization valve 50 being thereby positioned within the releasable assembly. Note that the ports 58 will be positioned below the annular seals 42, so that the ports 58 are exposed to the annulus 34 below the annular seals 42 when the releasable assembly 40 is installed in the outer housing 26.

Figure 10:
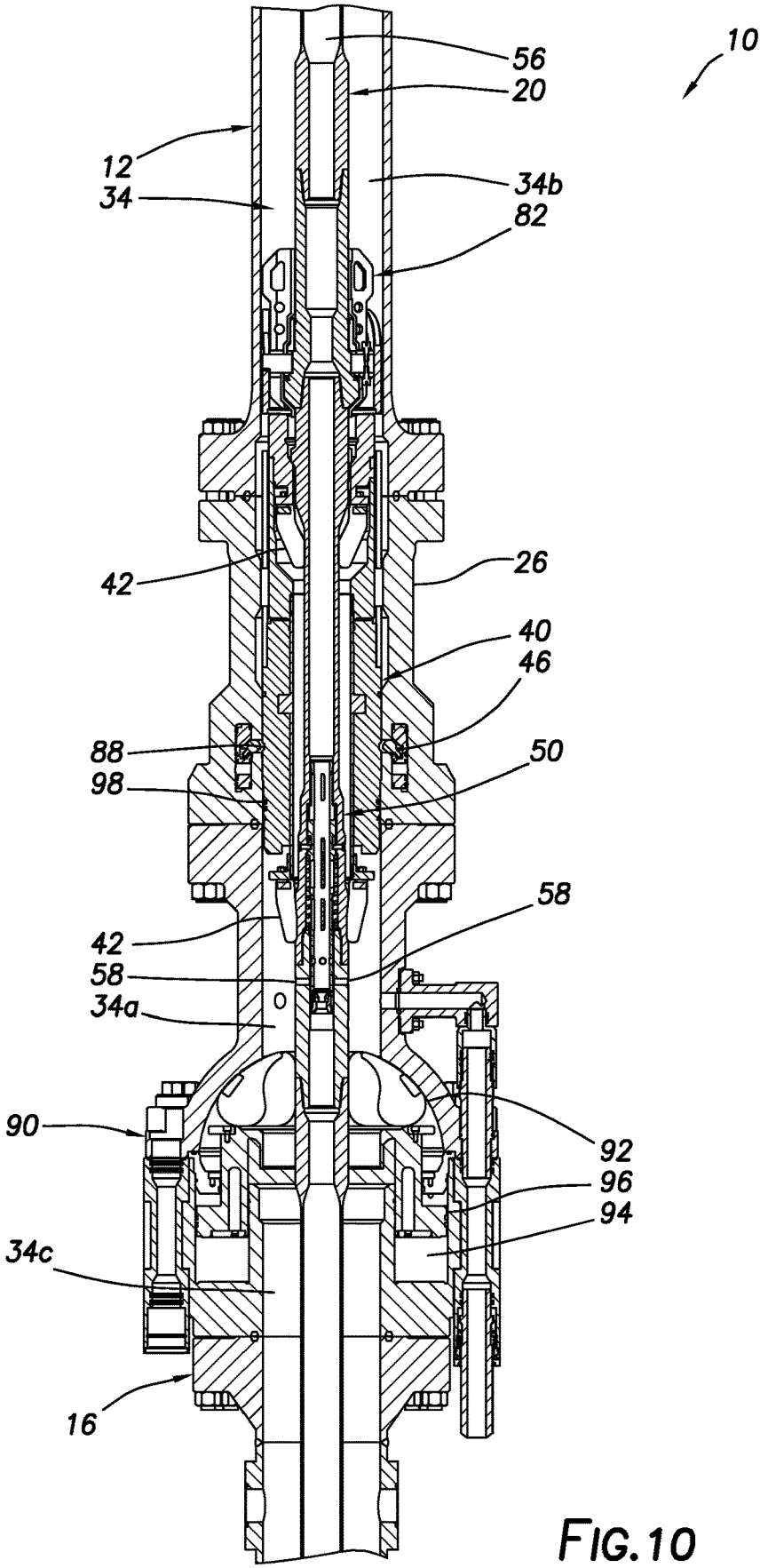
FIG. 10 is a representative cross-sectional view of the running tool, equalization valve and releasable assembly positioned in an example of a riser string.

Referring additionally now to FIG. 10, a cross-sectional view of the system 10 is representatively illustrated. In this view, the releasable assembly 40 is positioned in the outer housing 26 and is releasably secured to the running tool 82. The latch 46 is not activated to engage the recess 88 at this point. Thus, the releasable assembly 40 may be in process of being installed in, or retrieved from, the outer housing 26.

A conventional annular blowout preventer 90 is connected at an upper end of the lower marine riser package 16. The annular blowout preventer 90 depicted in FIG. 10 is of the type that includes an annular seal 92 operable to displace radially inward into sealing engagement with an exterior surface of the tubular string 20 (for example, by applying increased pressure to a chamber 94 below a piston 96 abutting a lower end of the annular seal).

When the annular seal 92 is activated to sealingly engage the exterior surface of the tubular string 20, a section 34*a* of the annulus 34 will be isolated from another section 34*c* of the annulus, so that fluid communication between the annulus sections 34*a,c* will be prevented. Such a situation can occur during installation or retrieval of the releasable assembly 40.

In addition, note that the annular seals 42 of the releasable assembly 40 isolate the annulus section 34*a* from an upper section 34*b* of the annulus 34 which, in many cases, extends to surface. Thus, with the releasable assembly 40 positioned in the outer housing 26 (so that seals 98 carried on the releasable assembly are sealingly engaged with an interior surface of the outer housing), any pressure trapped in the annulus section 34*a* cannot be relieved via the upper annulus section 34*b*.

However, since the ports 58 are in communication with the annulus section 34*a*, by operating the equalization valve 50 to its open configuration (see FIG. 7), pressure in the annulus section 34*a* can be equalized with the interior flow passage 56 of the tubular string 20. As described above, the equalization valve 50 can be conveniently opened by flowing a fluid 74 through the passage 56 at or above a certain flow rate, and then reducing the flow rate, so that the pins 80 are at positions 80*c* (see FIG. 6).

Since the running tool 82 is detachable from the releasable assembly 40 by manipulation of the tubular string 20 (e.g., to release the lugs 86 from the slots 84, see FIG. 9), instead of being pressure actuated, pressure differentials or pressure variations due to the fluid flow through the passage 56 do not interfere with proper operation of the running tool. However, the scope of this disclosure is not limited to use of a mechanically actuated running tool (for example, a suitably designed pressure actuated running tool could accommodate pressure differentials or variations due to the fluid flow used to actuate the equalization valve 50). The equalization valve 50 can be retrieved from the well with the running tool 82 when the running tool 82 is detached from the releasable assembly 40.

Figure 11:
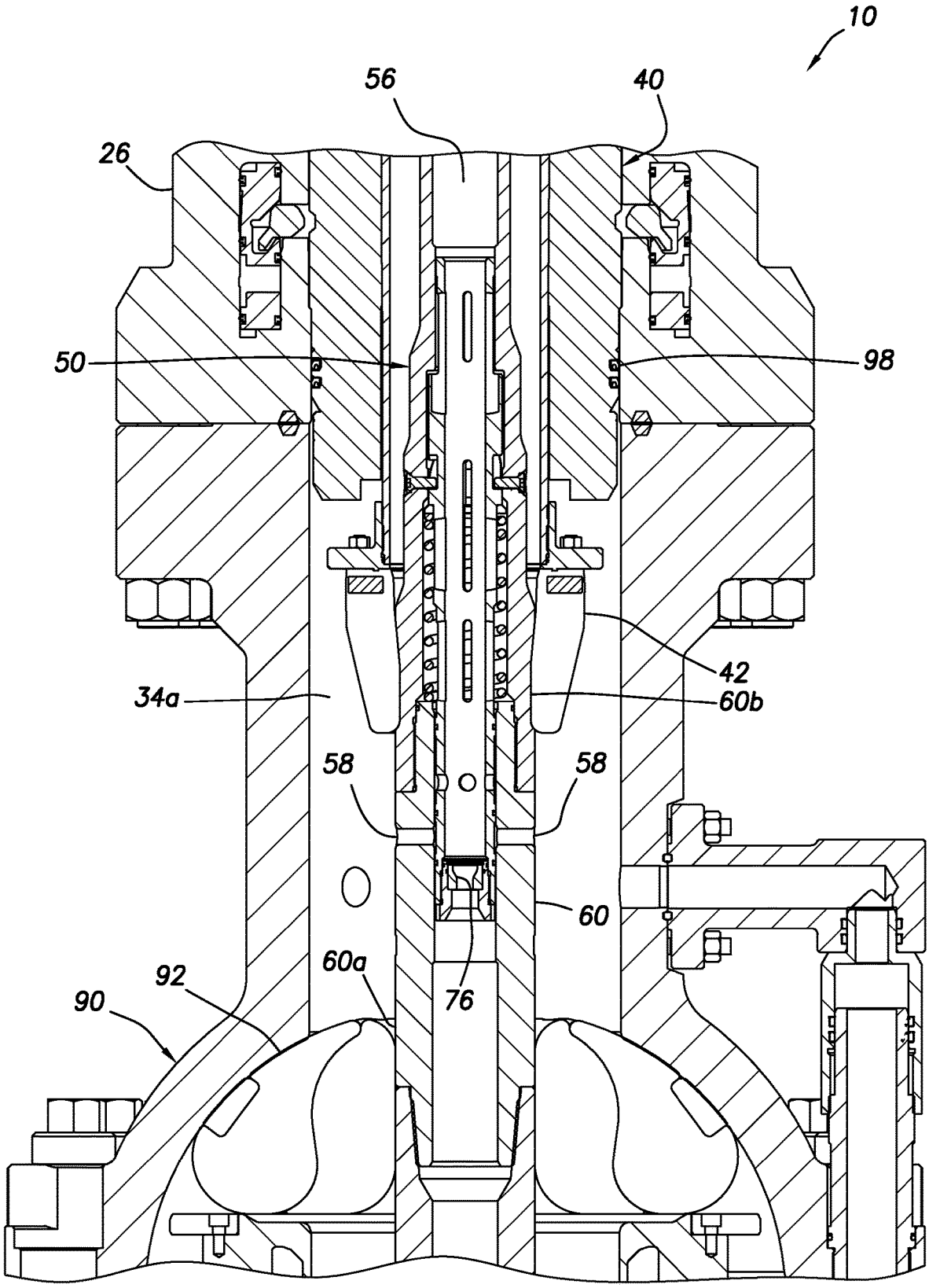
FIG. 11 is a representative somewhat enlarged scale cross-sectional view of the running tool, equalization valve and releasable assembly positioned in the riser string.

Referring additionally now to FIG. 11, a more enlarged scale view of a portion of the system 10 is representatively illustrated. In this view it may be more clearly seen that the lower annular seal 42 of the releasable assembly 40 sealingly engages an exterior surface of the equalization valve housing assembly 60 at a location 60*b* that is longitudinally spaced apart from another location 60*a* that will be sealingly engaged by the annular seal 92 when the annular blowout preventer 90 is activated.

The ports 58 penetrate the exterior surface of the housing assembly 60 longitudinally between the locations 60*a,b* in this example. In this manner, the ports 58 are placed in fluid communication with the annulus section 34*a*. However, the scope of this disclosure is not limited to this arrangement or configuration (for example, either or both of the annular seals 42, 92 could sealingly engage the tubular string 20 at locations other than on the exterior surface of the housing assembly 60, etc.).

The equalization valve 50 can conveniently be used for pressure testing the annular seals 42 and/or the annular seal 92 when the equalization valve is in its open configuration (see FIG. 7). As mentioned above, an elevated pressure produced in the flow passage 56 upstream of the flow restriction 76 due to fluid flow through the passage will be communicated to the annulus 34 external to the equalization valve 50 in the open configuration. In the example depicted in FIG. 11, this elevated pressure will be communicated to the annulus section 34*a*.

With the elevated pressure communicated to the annulus section 34*a*, the upper annulus section 34*b* (see FIG. 10) can be monitored (for example, at the surface or via a remotely located sensor) for pressure variations that indicate leakage of the annular seals 42 (or seals 98). An increase in pressure in the upper annulus section 34*b* would indicate leakage of the annular seals 42 (or seals 98). Remotely located sensors (not shown) may also be used to monitor pressure in the annulus sections 34*a,c* to determine whether the annular seal 92 is leaking when it should be sealingly engaged with the tubular string 20.

It may now be fully appreciated that the above disclosure provides significant advancements to the art of installing and retrieving releasable assemblies of pressure control devices. In examples described above, the equalization valve 50 can be conveniently used when installing and retrieving the pressure control device releasable assembly 40, in order to provide fluid communication between the interior flow passage 56 and the annulus section 34*a* between the annular seals 42, 92. Fluid flow through the passage 56 can be used to actuate the equalization valve 50 between its open and closed configurations.

The above disclosure provides to the art a system 10 for use with a subterranean well. In one example, the system 10 can include a tubular string 20 positioned in a riser string 12. The riser string 12 includes an outer housing 26 of a pressure control device 48 (comprising the outer housing 26 and the releasable assembly 40) and a first annular seal 92 operable to prevent flow through an annulus 34 formed between the tubular string 20 and the riser string 12. The tubular string 20 includes an equalization valve 50 and a running tool 82 operable to convey the releasable assembly 40 of the pressure control device through the riser string 12. The equalization valve 50 selectively permits fluid communication between the annulus 34 and a flow passage 56 extending longitudinally through the tubular string 20.

A port 58 of the equalization valve 50 may be exposed to the annulus 34 between the first annular seal 92 and the releasable assembly 40. The port 58 may be positioned between first and second locations 60*a,b* on an exterior surface of the tubular string 20. The exterior surface first location 60*a* may be sealingly engaged by the first annular seal 92, and the exterior surface second location 60*b* may be sealingly engaged by a second annular seal 42 of the releasable assembly 40.

The releasable assembly 40 may include a second annular seal 42 operable to prevent flow through the annulus 34. The equalization valve 50 may selectively permit fluid communication between the flow passage 56 and a section 34*a* of the annulus 34 positioned between the first and second annular seals 92, 42.

The equalization valve 50 may open in response to a fluid 74 flow through the tubular string 20 at greater than a predetermined flow rate. The fluid 74 flow may produce a pressure differential from a first section 34*a* of the annulus 34 to a second section 34*b* of the annulus 34, the first section 34*a* being positioned between the first annular seal 92 and a second annular seal 42 of the releasable assembly 40, with the second annular seal 42 being positioned between the first and second sections 34*a,b*.

The fluid 74 flow may produce a pressure differential from a first section 34*a* of the annulus 34 to a second section 34*c* of the annulus 34, the first section 34*a* being positioned between the first annular seal 92 and a second annular seal 42 of the releasable assembly 40, the first annular seal 92 being positioned between the first and second sections 34*a,c*.

The above disclosure also provides to the art a method for use with a subterranean well. In one example, the method comprises: positioning a tubular string 20 in a riser string 12, the riser string 12 including an outer housing 26 of a pressure control device 48 and a first annular seal 92 operable to prevent flow through an annulus 34 formed between the tubular string 20 and the riser string 12, the tubular string 20 including an equalization valve 50 and a running tool 82 operable to convey a releasable assembly 40 of the pressure control device 48 through the riser string 12; and opening the equalization valve 50, thereby permitting fluid communication between the annulus 34 and a flow passage 56 extending longitudinally through the tubular string 20.

The fluid communication permitting step may comprise permitting flow through a port 58 of the equalization valve 50, the port 58 being exposed to the annulus 34 between the first annular seal 92 and the releasable assembly 40.

The positioning step may comprise positioning the port 58 between first and second locations 60*a,b* on an exterior surface of the tubular string 20, the exterior surface first location 60*a* being sealingly engaged by the first annular seal 92, and the exterior surface second location 60*b* being sealingly engaged by a second annular seal 42 of the releasable assembly 40.

The releasable assembly 40 may include a second annular seal 42 operable to prevent flow through the annulus 34. The fluid communication permitting step may comprise permitting fluid communication between the flow passage 56 and a section 34*a* of the annulus 34 positioned between the first and second annular seals 92, 42.

The fluid communication permitting step may comprise flowing a fluid 74 through the tubular string 20 at greater than a predetermined flow rate. The fluid 74 flowing step may comprise producing a pressure differential from a first section 34*a* of the annulus 34 to a second section 34*b* of the annulus 34, the first section 34*a* being positioned between the first annular seal 92 and a second annular seal 42 of the releasable assembly 40, with the second annular seal 42 being positioned between the first and second sections 34*a,c*.

The fluid flowing step may comprise producing a pressure differential from a first section 34*a* of the annulus 34 to a second section 34*c* of the annulus 34, the first section 34*a* being positioned between the first annular seal 92 and a second annular seal 42 of the releasable assembly 40, with the first annular seal 92 being positioned between the first and second sections 34*a,c*.

A system 10 for use with a subterranean well is also described above. In one example, the system 10 can comprise a riser string 12 including an annular blowout preventer 90, the annular blowout preventer 90 including a first annular seal 92 displaceable into sealing contact with an exterior surface of a tubular string 20 to thereby prevent flow through an annulus 34 between the riser string 12 and the tubular string 20. The tubular string 20 includes a running tool 82 and an equalization valve 50. The running tool 82 is releasably attachable to a releasable assembly 40.

The releasable assembly 40 is releasably securable in the riser string 12. The releasable assembly 40 includes a second annular seal 42 that sealingly and slidingly contacts the exterior surface of the tubular string 20. The equalization valve 50 selectively prevents and permits fluid communication between a flow passage 56 extending longitudinally through the tubular string 20 and a first section 34*a* of the annulus 34 positioned between the first and second annular seals 92, 42.

The equalization valve 50 may operate between open and closed configurations in response to variations in fluid 74 flow rate through the tubular string 20.

The equalization valve 50 may include a port 58 positioned between the first and second annular seals 92, 42. The port 58 may penetrate the exterior surface between a first location 60*a* on the exterior surface sealingly engaged by the first annular seal 92 and a second location 60*b* on the exterior surface sealingly engaged by the second annular seal 42.

The equalization valve 50 may be connected in the tubular string 20 between the running tool 82 and a drill bit 24 connected at a distal end of the tubular string 20.

The second annular seal 42 may sealingly contact the equalization valve 50.

The equalization valve 50 may be retrievable from the well with the running tool 82 in response to release of the running tool 82 from the releasable assembly 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used.

Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a tubular string positioned in a riser string, the riser string including an outer housing of a pressure control device and a first annular seal operable to prevent flow through an annulus formed between the tubular string and the riser string, the tubular string including an equalization valve and a running tool operable to convey a releasable assembly of the pressure control device through the riser string, the releasable assembly being releasably securable in the outer housing, and the equalization valve selectively permitting fluid communication between the annulus and a flow passage extending longitudinally through the tubular string, in which the equalization valve opens in response to a fluid flow in a downward direction through the flow passage at greater than a predetermined flow rate.

2. The system of claim 1, in which a port of the equalization valve is exposed to the annulus between the first annular seal and the releasable assembly.

3. The system of claim 2, in which the port is positioned between first and second locations on an exterior surface of the tubular string, the exterior surface first location being sealingly engaged by the first annular seal, and the exterior surface second location being sealingly engaged by a second annular seal of the releasable assembly.

4. The system of claim 1, in which the releasable assembly includes a second annular seal operable to prevent flow through the annulus, and in which the equalization valve selectively permits fluid communication between the flow passage and a section of the annulus positioned between the first and second annular seals.

5. The system of claim 1, in which the fluid flow produces a pressure differential from a first section of the annulus to a second section of the annulus, the first section being positioned between the first annular seal and a second annular seal of the releasable assembly, the second annular seal being positioned between the first and second sections.

6. The system of claim 1, in which the fluid flow produces a pressure differential from a first section of the annulus to a second section of the annulus, the first section being positioned between the first annular seal and a second annular seal of the releasable assembly, the first annular seal being positioned between the first and second sections.

7. A method for use with a subterranean well, the method comprising:

positioning a tubular string in a riser string, the riser string including an outer housing of a pressure control device and a first annular seal operable to prevent flow through an annulus formed between the tubular string and the riser string, the tubular string including an equalization valve and a running tool operable to convey a releasable assembly of the pressure control device through the riser string, the releasable assembly being releasably securable in the outer housing; and opening the equalization valve, thereby permitting fluid communication between the annulus and a flow passage extending longitudinally through the tubular string, in which the permitting fluid communication comprises flowing a fluid in a downward direction through the flow passage at greater than a predetermined flow rate.

8. The method of claim 7, in which the fluid communication permitting comprises permitting flow through a port of the equalization valve, the port being exposed to the annulus between the first annular seal and the releasable assembly.

9. The method of claim 8, in which the positioning comprises positioning the port between first and second locations on an exterior surface of the tubular string, the exterior surface first location being sealingly engaged by the first annular seal, and the exterior surface second location being sealingly engaged by a second annular seal of the releasable assembly.

10. The method of claim 7, in which the releasable assembly includes a second annular seal operable to prevent flow through the annulus, and in which the fluid communication permitting comprises permitting fluid communication between the flow passage and a section of the annulus positioned between the first and second annular seals.

11. The method of claim 7, in which the fluid flowing comprises producing a pressure differential from a first section of the annulus to a second section of the annulus, the first section being positioned between the first annular seal and a second annular seal of the releasable assembly, the second annular seal being positioned between the first and second sections.

12. The method of claim 7, in which the fluid flowing comprises producing a pressure differential from a first section of the annulus to a second section of the annulus, the first section being positioned between the first annular seal and a second annular seal of the releasable assembly, the first annular seal being positioned between the first and second sections.

13. A system for use with a subterranean well, the system comprising:

a riser string including an annular blowout preventer, the annular blowout preventer including a first annular seal displaceable into sealing contact with an exterior surface of a tubular string to thereby prevent flow through an annulus between the riser string and the tubular string; and the tubular string including a running tool and an equalization valve, the running tool being releasably attachable to a releasable assembly, the releasable assembly being releasably securable in the riser string, the releasable assembly including a second annular seal that sealingly and slidingly contacts the exterior surface of the tubular string, and the equalization valve selectively preventing and permitting fluid communication between a flow passage extending longitudinally through the tubular string and a first section of the annulus positioned between the first and second annular seals, in which the equalization valve operates between open and closed configurations in response to variations in fluid flow rate of a downward fluid flow through the flow passage.

14. The system of claim 13, in which the equalization valve includes a port positioned between the first and second annular seals.

15. The system of claim 14, in which the port penetrates the exterior surface between a first location on the exterior surface sealingly engaged by the first annular seal and a second location on the exterior surface sealingly engaged by the second annular seal.

16. The system of claim 13, in which the equalization valve is connected in the tubular string between the running tool and a drill bit connected at a distal end of the tubular string.

17. The system of claim 13, in which the second annular seal sealingly contacts the equalization valve.

18. The system of claim 13, in which the equalization valve is retrievable from the well with the running tool in response to release of the running tool from the releasable assembly.

* * * * *